US007841687B2

(12) United States Patent
Cai et al.

(10) Patent No.: US 7,841,687 B2
(45) Date of Patent: Nov. 30, 2010

(54) SYSTEM AND METHOD FOR IDENTIFYING A PRESCRIBED INKJET INK

(75) Inventors: Xiaorong Cai, Lexington, KY (US); Ajay Kanubhai Suthar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 181 days.

(21) Appl. No.: 12/186,578

(22) Filed: Aug. 6, 2008

(65) Prior Publication Data

US 2010/0033519 A1 Feb. 11, 2010

(51) Int. Cl.
*B41J 29/393* (2006.01)

(52) U.S. Cl. ..... 347/19; 347/7; 347/81

(58) Field of Classification Search ..... 347/14, 347/19, 81, 6–7, 20, 84–87, 101–104, 35
See application file for complete search history.

(56) References Cited

U.S. PATENT DOCUMENTS 5,656,071 A 8/1997 Kappele et al.
6,293,143 B1 9/2001 Denton et al.
6,322,192 B1 * 11/2001 Walker ..... 347/19
6,646,024 B2 11/2003 Beach et al.
7,438,378 B2 * 10/2008 Reichelsheimer et al. ..... 347/19

* cited by examiner

*Primary Examiner*—Thinh H Nguyen

(57) ABSTRACT

A system for identifying a prescribed inkjet ink includes a controlled substrate, a quantity of ink dispensed from a printhead of an ink cartridge onto the controlled substrate which supports the dispensed ink in a freestanding form, a light emitter configured and positioned to transmit light in a first preselected wavelength bandwidth onto the freestanding dispensed ink, a light sensor configured and positioned to detect light m a second preselected wavelength bandwidth different from the first preselected wavelength bandwidth by a fluorescent additive contained in the freestanding dispensed ink, and a signal analyzer electrically connected to the light sensor and operable to produce an electrical output signal corresponding to such light emissions such that an electrical output signal above a given level is indicative of the presence of the prescribed ink in the ink cartridge.

20 Claims, 5 Drawing Sheets

SYSTEM AND METHOD FOR IDENTIFYING A PRESCRIBED INKJET INK

CROSS-REFERENCE TO RELATED APPLICATIONS

This patent application is related to the following copending U.S. patent applications assigned to the assignee of the present invention: (1) Ser. No. 11/934,142, filed Nov. 2, 2007, entitled "Ink Identification And Detection System With Ink For Use Therewith"; (2) Ser. No, 11/835,682, filed Aug. 8, 2007, entitled "Fluorescent-Wax Emulsion For Pigment Ink Detection"; and (3) Ser. No. 11/774,628, filed Jul. 9, 2007, entitled "Printhead Auto-Alignment Detection System That Uses A Printed Printhead Alignment Pattern Containing Fluorescing Material", Disclosures of these applications are hereby incorporated by reference herein.

BACKGROUND

1. Field of the Invention

The present invention relates generally to ink compositions used in inkjet imaging printheads and, more particularly, to a system and method for identifying a prescribed inkjet ink.

2. Description of the Related Art

An inkjet imaging system, such as an inkjet printing system, forms an image on a print medium by ejecting ink from a plurality of ink jetting nozzles of an inkjet printhead to form a pattern of ink dots on the print medium. Inkjet printing is accomplished without contact between the printing system and the print medium. Such printing system typically includes a permanent or semi-permanent printhead and one or more ink cartridges in which the ink supplied to the printhead is stored. The ink cartridge may be replaced once consumed during the printing operation.

U.S. Pat. Nos. 5,656,071 & 6,646,024, assigned to the assignee of the present invention, indicate an ongoing recognition that different ink compositions can differently affect print quality and printer maintenance problems. Thus, the composition of inks used in an inkjet printing system has been of long-standing concern. This is especially true where a printer manufacturer wants to offer customers a warranty/service policy for its printing systems. To do this the manufacturer needs to be able to stipulate as a condition that a particular ink composition has to be used and to detect when this condition is not being fulfilled. Hence, there is a need for a way to identify whether the prescribed composition of ink is actually being employed in a printing system that a manufacturer sells and services under its warranty/service policy.

It is known from U.S. Pat. No. 6,293,143 also assigned to the assignee of the present invention, to add fluorescent material to ink to assist in sensing a low ink level in an ink cartridge. The ink level sensing apparatus of the '143 patent is employed in association with an ink cartridge having an ink chamber containing ink and substantially insoluble fluorescent material in the ink. The fluorescent material has a specific gravity which is sufficiently lower than the ink such that the fluorescent material floats at or near the surface of the ink to provide an interface between it and the ink.

The apparatus of the '143 patent includes a light source, such as a light emitting diode (LED), for emitting substantially visible light of a first wavelength bandwidth along a light path through a substantially transparent side panel of the cartridge adjacent the ink chamber. The apparatus of the '143 patent also includes a photo sensor, such as a phototransistor, for detecting light emissions from the fluorescent material in the ink excited by the light of the first wavelength bandwidth when the material crosses the light path, the detected light emissions from the fluorescent material being of a second wavelength bandwidth different from and higher than the first wavelength bandwidth.

The apparatus of the '143 patent further includes a filter between the fluorescent material and the photo sensor for blocking light within the first wavelength bandwidth emitted by the light emitter and passing light within the second wavelength bandwidth such as emitted by the fluorescent material. The primarily visible light emitted by the light emitter and received by the photo sensor has to travel through the transparent wall of the ink cartridge in going to and from the fluorescent material in the ink in the cartridge. A digital output signal generated by the photo sensor is sent to a printer control to signal a low ink level alarm which may be an audible or visible signal, a message on a computer monitor, etc., or a signal to terminate printing operations.

However, this approach is concerned with sensing when an ink cartridge is almost empty by detecting the presence of an interface between the ink and a non-soluble fluorescent material. This approach is not concerned with sensing a given level of emissions from a fluorescent material in order to identify the ink about to be used nor is it concerned with whether the ink should or should not he used in the first instance. Thus, the need remains for an approach to identifying whether the prescribed composition of ink is about to be used in the printing system that a manufacturer sells and services tender its warranty/service policy.

SUMMARY OF THE INVENTION

Embodiments of the present invention meet this need by identifying a prescribed ink from an ink cartridge before it is used in the printing system. By successfully exciting and sensing fluorescence emissions of a given level from a waste sample of ink the presence of the prescribed ink is detected in the ink sample. The ink sample used is one initially spitted from a printhead onto a controlled substrate where it forms a freestanding quantity of ink. The spitting of the ink is an expected part of installation of the ink cartridge and it occurs before use of the ink in the printing system.

Accordingly, in an aspect of the present invention, a system for identifying a prescribed inkjet ink includes a controlled substrate, a quantity of ink dispensed from a printhead of an ink cartridge onto the controlled substrate which supports the dispensed ink in a freestanding form, a light emitter configured and positioned to transmit light in a first preselected wavelength bandwidth onto the freestanding dispensed ink, a photo sensor configured and positioned to detect light in a different second preselected wavelength bandwidth that is emitted by a fluorescent additive contained in the freestanding dispensed ink, and a signal analyzer electrically connected to the photo sensor and operable to produce an electrical output signal corresponding to such light emissions such that an electrical output signal above a given level is indicative of the presence of the prescribed ink in the ink cartridge.

In another aspect of the present invention, a method for identifying a prescribed inkjet ink includes dispensing a quantity of ink from a printhead of an ink cartridge onto a controlled substrate which supports the dispensed ink in a freestanding form, transmitting light in a first preselected wavelength bandwidth onto the freestanding dispensed ink, detecting light in a different second preselected wavelength bandwidth emitted by a fluorescent additive contained in the freestanding dispensed ink, and producing an electrical output signal corresponding to such light emissions such that an electrical output signal above a given level is indicative of the presence of the prescribed ink in the ink cartridge.

BRIEF DESCRIPTION OF THE DRAWINGS

Figure 1:
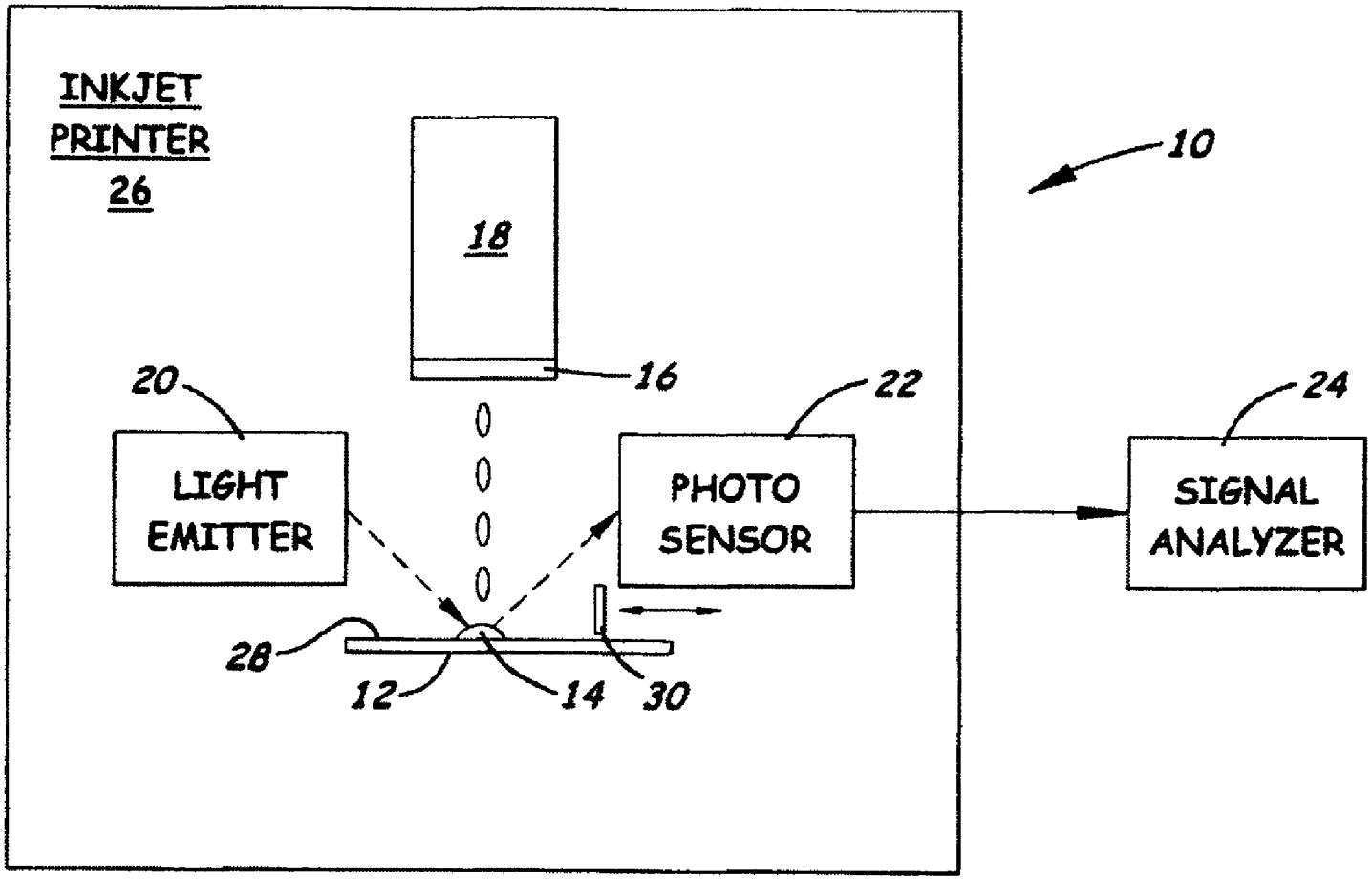

Having thus described the invention in general terms, reference will now be made to the accompanying drawings, which are not necessarily drawn to scale, and wherein:

FIG. 1 is a diagram of an embodiment of a system for identifying a prescribed inkjet ink according to the present invention.

Figure 2:
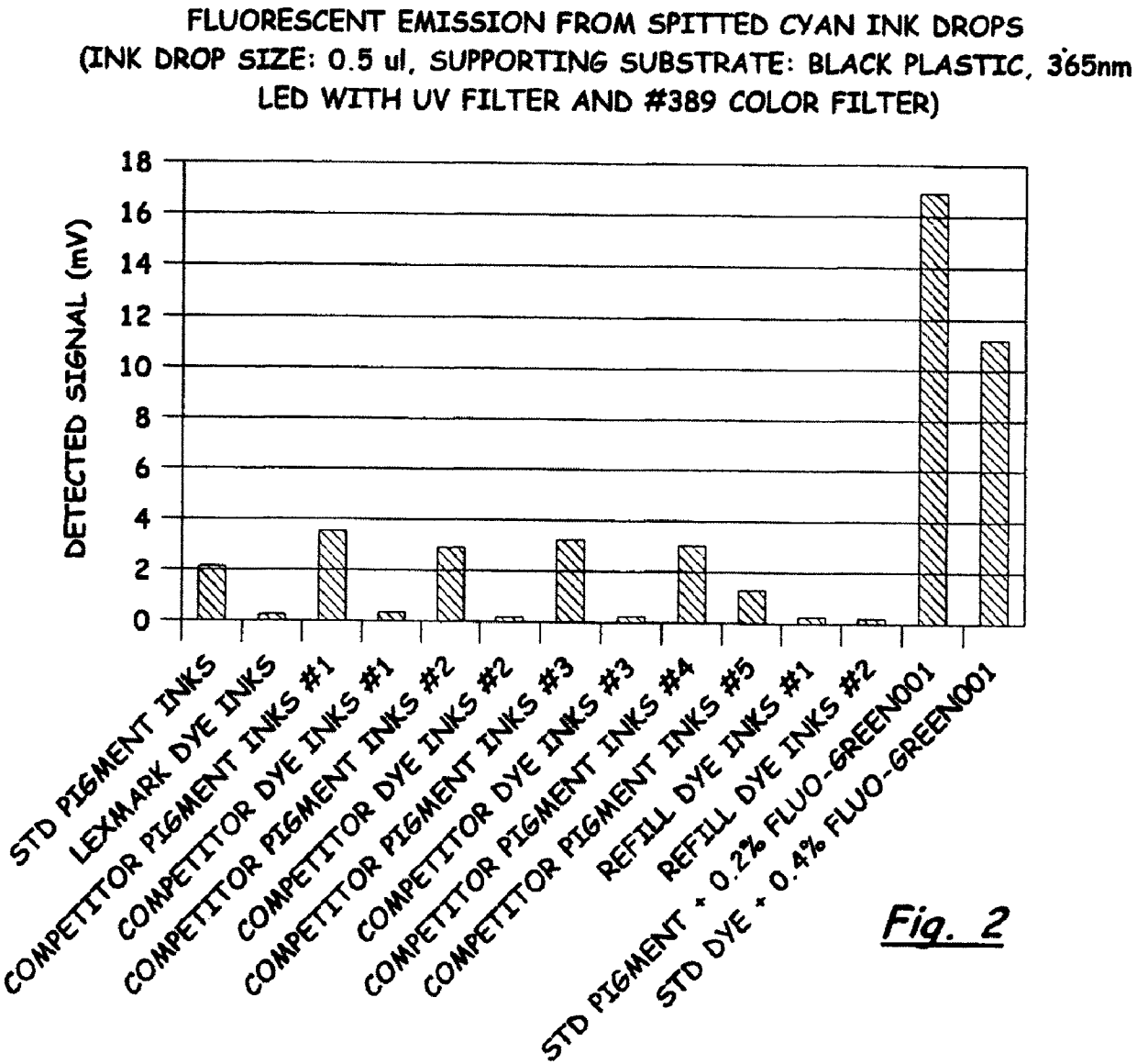

FIG. 2 is a graph of electrical signal levels generated by emissions detected from various cyan pigment and dye inks with and without significant amounts of invisible fluorescent green dyes.

Figure 3:
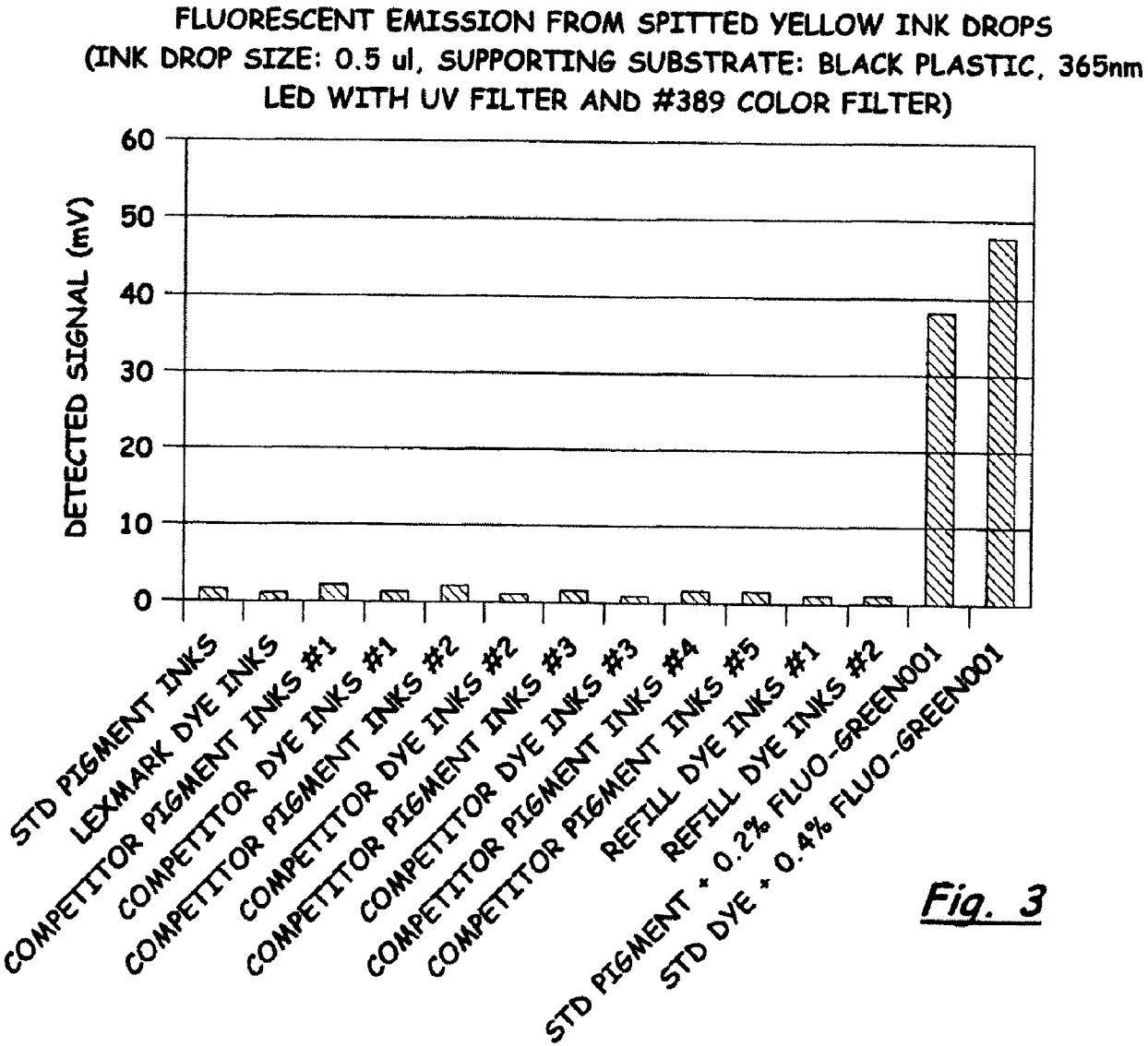

FIG. 3 is a graph of electrical signal levels generated by emissions detected from various yellow pigment and dye inks with and without significant amounts of an invisible fluorescent green dye.

Figure 4:
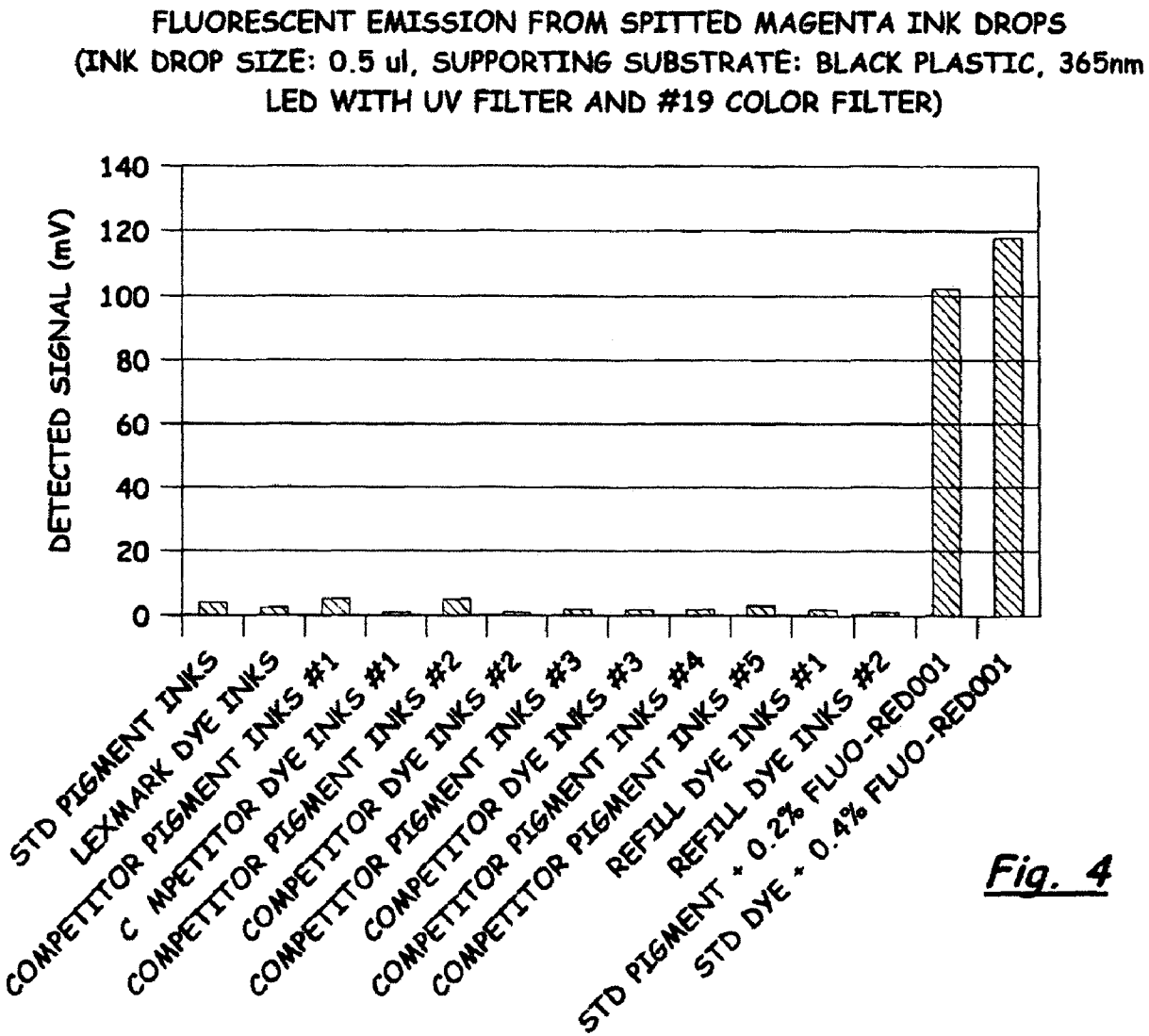

FIG. 4 is a graph of electrical signal levels generated by emissions detected from various magenta pigment and dye inks with and without significant amounts of an invisible fluorescent red dye.

Figure 5:
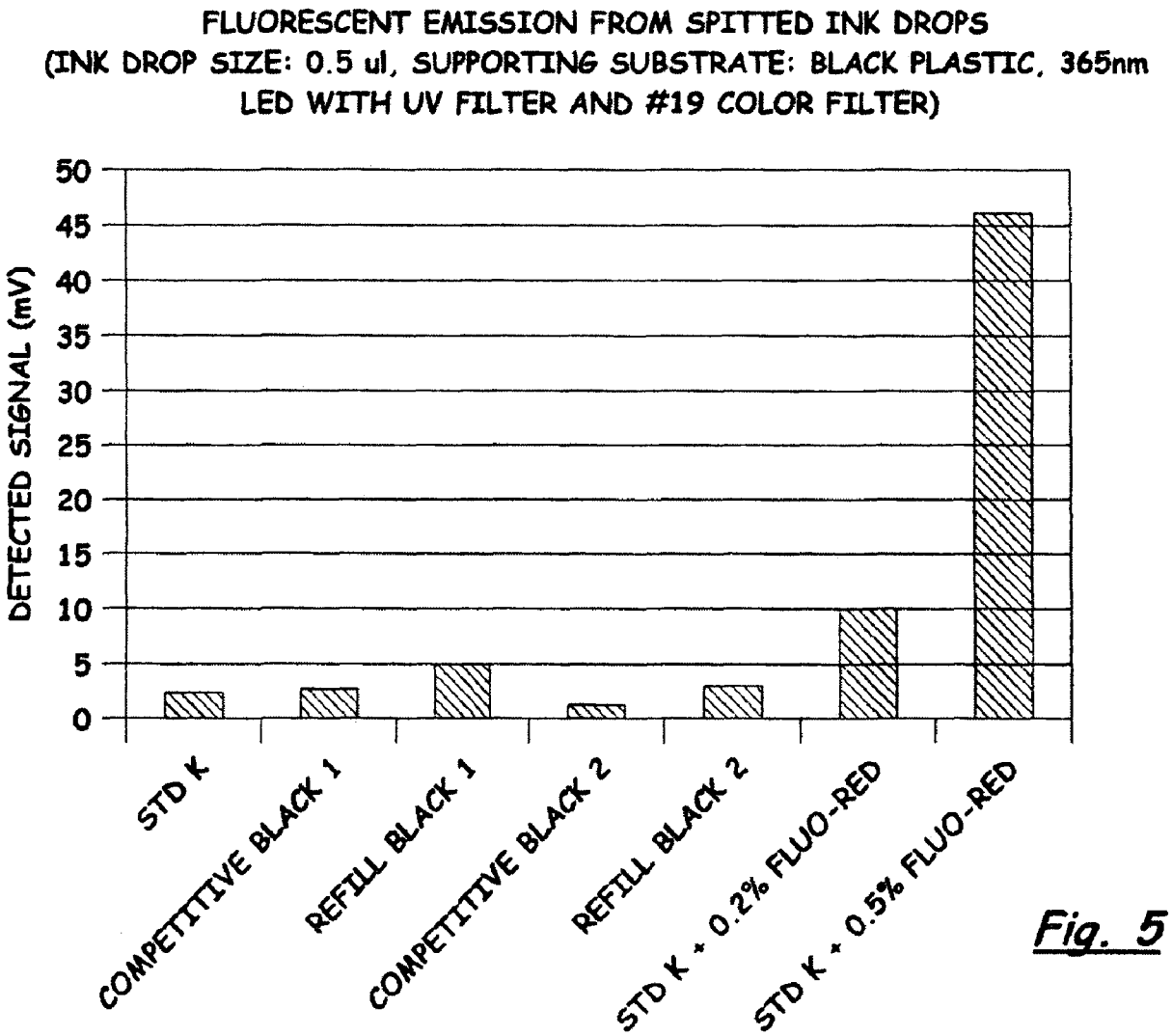

FIG. 5 is a graph of electrical signal levels generated by emissions detected from various black pigment and dye inks with and without significant amounts of an invisible fluorescent red dye.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated an exemplary embodiment of a system of the present invention, generally designated 10, for identifying a prescribed inkjet ink includes a controlled substrate 12 having a quantity of ink 14 dispensed from a printhead 16 of an ink cartridge 18 onto the controlled substrate 12 which supports the dispensed ink in a freestanding form. The system of the present invention further includes a light emitter 20 configured and positioned to transmit light in a first preselected wavelength bandwidth onto the freestanding dispensed quantity of ink 14, a photo sensor 22 configured and positioned to detect light in a second preselected wavelength bandwidth different from the first preselected wavelength bandwidth emitted by a fluorescent additive contained in the freestanding dispensed quantity of ink 14, and a signal analyzer 24 electrically connected to the photo sensor 22 and operable to produce an electrical output signal corresponding to such light emissions such that an electrical output signal above a given level is indicative of the presence of the prescribed ink in the ink cartridge 18. The light emitter 20 can be a single LED with a peak wavelength that is the same as or very close to the exciting wavelength of the fluorescent additive employed. The peak wavelength of this LED may be in the UV region (for example, 365 nm). The photo sensor 22 may have a filter to allow the fluorescent emission only. Thus, the photo sensor 22 would "see" all inks equally well at the specific wavelength, that of the peak emission from the preselected fluorescent additives.

The system 10 is mounted on components of an inkjet printer 26 or in the near vicinity thereof such that every time when an ink cartridge 18 is installed into the printer, certain amount of ink 14 is spitted from the nozzles of the printhead 16. The spitted or jetted ink 14 lands on the controlled substrate 12 which takes the form of a material containing carbon black, which provides minimum light reflection, and having a smooth flat surface 28, such as a black plastic material. A wiper 30 may be provided to wipe the spitted ink 14 front the surface 28 of the substrate 12 immediately after operation of the system 10.

Thus, the present invention is premised on there being a preselected amount of fluorescent additive present in the freestanding dispensed ink 14 that is detectable in order to identify the presence of a prescribed ink in the ink cartridge 18. It is anticipated that an invisible fluorescent material is added to and mixed uniformly with the ink. The added material has a narrow absorbing wavelength bandwidth and narrow emitting wavelength bandwidth such that when the light within the narrow absorbing bandwidth excites on the ink, the signal within the narrow emitting bandwidth comes only or mainly from the added fluorescent material (none or very little comes from the ink itself). For example, a fluorescent material could be added that absorbs light in the non-visible spectrum of light (below 400 nm—UV) and re-emits light in the visible or near-IR spectrum of light (about 400 nm to 1000 nm). This material can be invisible or visible within the visible spectrum. It would absorb in the UV bandwidth and re-emit in the visible or near-IR range of about 400 nm-1000 nm.

Furthermore, the fluorescent additive may be an invisible UV fluorescent dye or pigment processed as wax emulsion, latex emulsion, or dispersion. Some UV fluorescent colorants can also be added to the inks directly. The UV fluorescent colorant absorbs UV light from the UV LED in the wavelength bandwidth between 250 nm to 400 nm and emit in visible range between 500 nm to 700 nm which can be detected by a clear sensor.

The UV fluorescent colorant employed in the system of the present invention may be an invisible or visible fluorescent dye or pigment. Suitable materials are some organic fluorescent dye/pigments, such as derivatives of benzoxazine and benzoxazinone or complexes of rare earth elements with ligards containing beta, Diketones. Other colorants such as fluorescent derivatives of dansyl chloride, coumarin, carbocyanine, naphthalamide, stilbene, squarine, perylene, xanthene, thioxanthene, thioindigod, acridine, and anthrapyridone dye and pigments would also be included for this application.

The following examples are of pigment and dye inks of different standard colors with and without fluorescent additives which were tested using the system and method of the present invention. FIGS. 2-5 depict the results of testing the inks in the respective following Examples I-IV. These examples are presented for illustrative purposes only, and are not intended as a restriction on the scope of the present invention.

EXAMPLES

System Employed:

As seen in FIG. 1, the system 10 employed in testing included the light emitter 20 in the form of a 365 UV LED with a UV filter to purify the UV light, the photo sensor 22 in the form of a phototransistor with a color filter, and a signal analyzer 24 in the form of a multi-meter used for signal level determination. Also, system 10 included a controlled substrate 12 in the form of a black plastic film on which an ink drop 14 in a freestanding form was tested.

Testing Methods:

Ink was dropped onto a black plastic film using a pipette. The size of each ink drop was precisely measured to be 0.5 μl which is the size range of the spitted inks from the printhead. The distance between the LED surface and the ink drop in the following examples was 9 mm and from ink sample to sensor surface was 10 mm.

Inks:

Example I: (1) Lexmark standard cyan pigment ink; (2) Lexmark standard cyan pigment ink containing: 0.2% Fluo-Green001 (Keyfluor Green OB-505, invisible fluorescent green dye from Keystone Aniline, processed in Lexmark as a stable dispersion); (3) Lexmark standard cyan dye ink; (4) Lexmark standard cyan dye ink containing: 0.4% Fluo-Green001 (Keyfluor Green OB-505, invisible fluorescent green dye from Keystone Aniline, processed in Lexmark as a stable dispersion); (5) Refill cyan dye inks; (6) Competitor's pigment cyan inks; and (7) Competitor's cyan dye inks.

Example II: (1) Lexmark standard yellow pigment ink; (2) Lexmark standard yellow pigment ink containing: 0.2% Fluo-Green001 (Keyfluor Green OB-505, invisible fluorescent green dye from Keystone Aniline, processed in Lexmark as a stable dispersion); (3) Lexmark standard yellow dye ink; (4) Lexmark standard yellow dye ink containing: 0.2% Fluo-Green001 (Keyfluor Green OB-505, invisible fluorescent green dye from Keystone Aniline, processed in Lexmark as a stable dispersion); (5) Refill yellow dye inks; (6) Competitor's pigment yellow inks; and (7) Competitor's yellow dye inks.

Example III: (1) Lexmark standard magenta pigment ink; (2) Lexmark standard magenta pigment ink containing: 0.2% Fluo-Red001 (Keyfluor Red OB-615, invisible fluorescent red dye from Keystone Aniline, processed in Lexmark as a stable dispersion); (3) Lexmark standard magenta dye ink; (4) Lexmark standard magenta dye ink containing: 0.2% Fluo-Red001 (Keyfluor Red OB-615, invisible fluorescent red dye from Keystone Aniline, processed in Lexmark as a stable dispersion); (5) Refill magenta dye inks; (6) Competitor's magenta pigment inks; and (7) Competitor's magenta dye inks.

Example IV: (1) Lexmark standard pigment black ink; (2) Lexmark standard pigment black ink containing: 0.25% Fluo-Red001 (Keyfluor Red OB-615, invisible fluorescent red dye from Keystone Aniline, processed in Lexmark as a stable dispersion): (3) Refill black dye inks; (4) Competitor's pigment black inks; and (5) Refill pigment black inks.

Results:

The fluorescent emissions of the various ink drops on the black plastic surface was measured as voltage signals using a phototransistor. In FIGS. 2-5, there is illustrated the voltage readings reflecting the existence of fluorescent materials in the pigment and dye inks, with the higher amounts of fluorescent material identifying the prescribed inks that gave higher voltage readings. The voltage readings given from the detectable inks are usually three to ten times higher than the readings from other inks. For example in FIG. 4, the signal from the detectable inks is about eight times greater than the readings from other pigment or dye inks. The selected color filter #389 from Roscolux filter book (from Rosco Laboratories Inc.) was used for cyan and yellow inks and #19 filter was used for magenta and blank inks. The application of color filter optimizes signal to noise level of the detection.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for identifying a prescribed inkjet ink, comprising:

a controlled substrate containing carbon black configured to receive a quantity of ink dispensed from a printhead of an ink cartridge onto the carbon black of said controlled substrate which supports the dispensed ink in a freestanding form;

a light emitter configured and positioned to transmit light in a first preselected wavelength bandwidth onto the freestanding dispensed ink;

a photo sensor configured and positioned to detect light in a second preselected wavelength bandwidth different from said first preselected wavelength bandwidth emitted by a fluorescent additive contained in the freestanding dispensed ink; and a signal analyzer electrically connected to said photo sensor and operable to produce an electrical output signal corresponding to such light emissions such that an electrical output signal above a given level is indicative of the presence of the prescribed ink in the ink cartridge.

2. The system of claim 1 wherein said controlled substrate is a flat surface.

3. The system of claim 1 wherein at least one of said controlled substrate, light emitter and photo sensor is supported in an inkjet printer.

4. The system of claim 1 wherein said freestanding form of said dispensed ink is at least one drop of ink spitted from the ink cartridge printhead during an installation of the cartridge.

5. The system of claim 1 wherein said fluorescent additive is an invisible fluorescent material.

6. The system of claim 1 wherein said fluorescent additive is a visible fluorescent material.

7. The system of claim 1 wherein said light emitter is a light emitting diode having a peak wavelength approximately the same as an exciting wavelength of the preselected fluorescent additive in the ink.

8. The system of claim 1 wherein said light emitting diode operates in a UV bandwidth.

9. The system of claim 1 further comprising:

a filter adapted to absorb light in said first preselected wavelength bandwidth and pass light in said second preselected wavelength bandwidth.

10. The system of claim 1 wherein said photo sensor is a phototransistor with a filter adapted to absorb light in said first preselected wavelength bandwidth and pass light in said second preselected wavelength bandwidth.

11. A method for identifying a prescribed inkjet ink, comprising:

dispensing a quantity of ink from an ink cartridge printhead onto carbon black of a controlled substrate which supports the dispensed ink in a freestanding form;

transmitting light in a first preselected wavelength bandwidth onto the freestanding dispensed ink;

detecting light in a second preselected wavelength bandwidth different from the first preselected wavelength bandwidth emitted by a preselected amount of fluorescent additive contained in the freestanding dispensed ink; and producing an electrical output signal corresponding to such light emissions such that an electrical output signal above a given level is indicative of the presence of the prescribed ink in the ink cartridge.

12. The method of claim 11 further comprising:

providing a material having a flat surface to serve as said controlled substrate.

13. The method of claim 11 further comprising:

supporting the controlled substrate in an inkjet printer.

14. The method of claim 11, wherein said dispensing includes spitting onto the controlled substrate in the free-standing form at least one drop of ink from an ink cartridge printhead upon installation of the cartridge in a printer.

15. The method of claim 11 further comprising:

supporting a light emitter in an inkjet printer for transmitting the light.

16. The method of claim 11 wherein said transmitting includes emitting light having a peak wavelength approximately the same as an exciting wavelength of the preselected fluorescent additive in the ink.

17. The method of claim 11 wherein said transmitting includes emitting light in a UV bandwidth.

18. The method of claim 11 further comprising:

supporting a photo sensor in an inkjet printer for detecting the emitted light.

19. The method of claim 11 further comprising:

filtering light emitted from the ink to absorb light in the first preselected wavelength bandwidth and pass light in the second preselected wavelength bandwidth.

20. The method of claim 11 wherein said filtering occurs before said detecting.

* * * * *